US005860817A

United States Patent [19]

Fieberling et al.

[11] Patent Number: 5,860,817

[45] Date of Patent: Jan. 19, 1999

[54] CONTACT FOR THE THROUGH-CONNECTION OF A PRINTED CIRCUIT BOARD

[75] Inventors: Bernd Fieberling, Worms; Georg Grella, Darmstadt; Vit Masek, Fürth, all of Germany

[73] Assignee: The Whitaker Corporation, Wilmington, Del.

[21] Appl. No.: 786,929

[22] Filed: Jan. 23, 1997

[30] Foreign Application Priority Data

Jan. 26, 1996 [DE] Germany ..... 196 02 832.9

[51] Int. Cl.[6] ..... H01R 9/09

[52] U.S. Cl. ..... 439/81; 439/940; 174/262

[58] Field of Search ..... 439/81, 82, 83, 439/84, 940; 174/262

[56] References Cited

U.S. PATENT DOCUMENTS

| | | | |
|---|---|---|---|
| 3,230,297 | 1/1966 | Means | 439/83 |
| 3,846,741 | 11/1974 | Kunkle et al. | 439/82 |
| 4,971,565 | 11/1990 | Fox, Jr. | 439/83 |
| 5,451,174 | 9/1995 | Bogursky et al. | 439/83 |

FOREIGN PATENT DOCUMENTS

| | | |
|---|---|---|
| 28 13 160-C2 | 10/1978 | Germany . |
| 38 14 903-C2 | 11/1989 | Germany . |
| 42 40 454-A1 | 12/1992 | Germany . |
| 44 21 731-A1 | 1/1996 | Germany . |

OTHER PUBLICATIONS

Abstract of Patent 4–242083 A, E–1304, Jan. 11, 1993, vol. 17, No. 13.

Abstract of Patent 6–37417 A, E–1548, May 16, 1994, vol. 18, No. 255.

*Primary Examiner*—Neil Abrams

[57] ABSTRACT

A contact for the through-connection of a printed circuit board through a hole is specified, having a central pin made of a conductive material; arms, which are designed in an essentially C-shaped manner, are arranged on the pin on two opposite sides; and a plastic body is provided on one end of the pin, which body surrounds the pin and, on the side facing away from the pin, has a surface extending perpendicularly to the pin, which can be used as suction surface for the automatic processing of the contact.

17 Claims, 1 Drawing Sheet

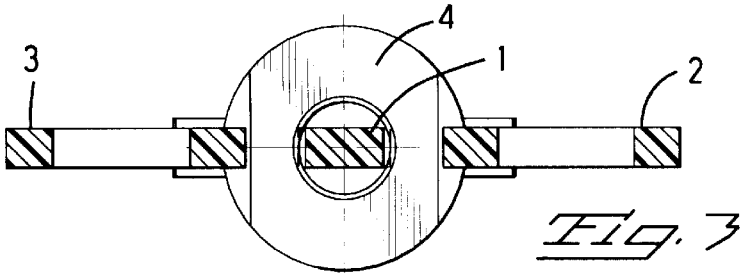
Fig. 3
Fig. 1
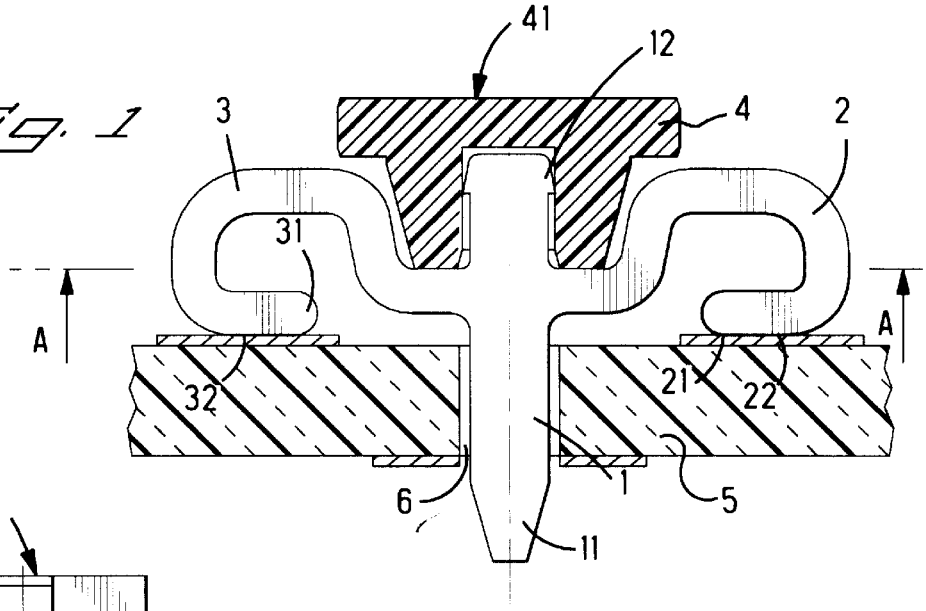
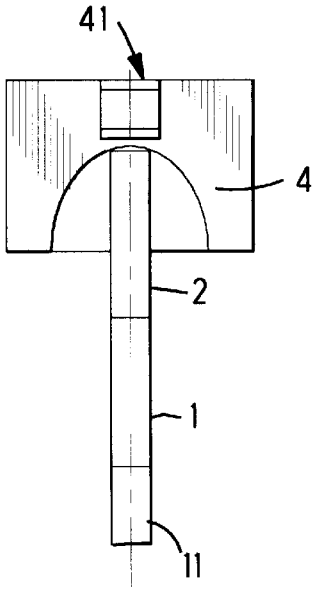
Fig. 2
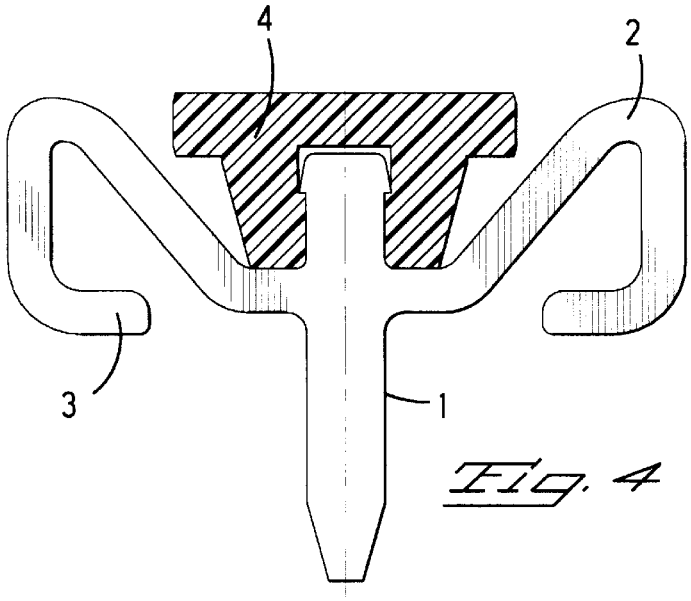
Fig. 4

CONTACT FOR THE THROUGH-CONNECTION OF A PRINTED CIRCUIT BOARD

BACKGROUND OF THE INVENTION

1. Field of the Invention

The invention relates to a contact for the through-connection of a printed circuit board.

2. Description of the Prior Art

Many applications in electrical engineering necessitate electrically connecting the two sides of an electrical printed circuit board to one another. This can be done, for example, by coating holes with a metal and thereby producing a through-plating. However, such a metal coating for the through-plating has the disadvantage that it is not suitable for relatively high current intensities. If relatively high current intensities are to be transmitted by the through-plating, then it is necessary, for example, to pass a wire made of a material having a high conductivity through the hole and to solder it on both sides of the printed circuit board. Automation of such a procedure is possible only with difficulty.

SUMMARY OF THE INVENTION

The object of the invention is to specify a contact for the through-connection of a printed circuit board through a hole, which contact can be processed in a largely automatic manner.

The object is achieved by means of a contact for the through-connection of a printed circuit board through a hole, having the following features: the contact has a central pin made of a conductive material; arms are arranged on the pin on two opposite sides; a body is provided on one end of the pin, surrounding the pin and, on the side facing away from the pin, having a surface extending perpendicularly to the pin. Advantageous developments are specified in the sub-claims.

The contact for the through-connection of a printed circuit board through a hole has a central pin having two arms made of a conductive material. The contact is designed in such a way that the central pin can be introduced into a hole and penetrates the printed circuit board through the hole and the arms fixed to the central pin come to rest on the top side of the printed circuit board. Arranged on that end of the pin which is opposite to the free end of the pin is a body having a surface whose surface normal is arranged parallel to the axis of the pin. This surface is suitable for use as suction surface for a pair of vacuum tweezers or a similar tool, for example of an automatic SMD processing installation. As a result, it becomes possible to mount the contact by means of automatic tools. The contact is additionally designed in such a way that on one side of the printed circuit board, it contacts the printed circuit board by the arms which can be fixed by means of reflow soldering, and on the other side, on which the pin penetrates through the board, the contact can be connected to conductor tracks by means of wave soldering.

It is particularly advantageous that the contact is very simple to produce since the pin with the arms is stamped and is then provided, for example, covered by injection-moulding, with the body made of plastic.

The design of the arms essentially in the form of Cs, which are fixed to the pin at one end and are freely moveable at the other end, has the advantage that this spring design makes it possible to compensate for different material expansions.

Particularly good spring properties are achieved by a design of the arms which has the following appearance: firstly angling of the arms at 45° away from the printed circuit board, then angling downwards parallel to the axis of the pin, finally free end parallel to the printed circuit board.

BRIEF DESCRIPTION OF THE DRAWINGS

FIG. 1 shows a side view of the contact, the body being illustrated in section;

FIG. 2 shows a view of the narrow side of the contact;

FIG. 3 shows a section along the line AA, as indicated in FIG. 1; and

FIG. 4 shows a side view with a particularly advantageous form of the arms.

DETAILED DESCRIPTION OF THE PREFERRED EMBODIMENT

FIG. 1 illustrates an example of a contact according to the invention. A central pin 1 with arms 2,3 is provided which is produced from a conductive material. The pin 1 with the arms 2,3 is particularly simple to produce by stamping from a metal sheet. The two arms 2,3 are arranged on opposite sides of the pin 1. The two arms 2, 3 are essentially C-shaped and their free ends 21, 31 are bent towards the pin. The arms 2, 3 have regions 32 and 22 which run perpendicularly to the pin and with which they touch a printed circuit board 5 when the pin is introduced through a hole 6 in a printed circuit board 5. The pin is introduced by its free end 11 into the printed circuit board 5. The free end 11 is bevelled to facilitate the introduction. The pin with the two arms can also fulfil its function of making contact between the two opposite sides of a printed circuit board even without the additionally provided body 4. On the side with the arms 2, 3, the pin 1 is fixed by means of reflow soldering, and on the opposite side wave soldering can be effected. The pin 1 additionally has an end which is opposite to the free end 11 and on which the pin 1 is connected to a body 4. The body advantageously consists of a non-conductive material, for example of a plastic. The body 4 has a planar surface 41 whose surface normal is oriented parallel to the axis of the pin 1. The surface 41 is provided for use as suction surface for a pair of vacuum tweezers. As a result, it becomes possible to fit the inventive contact for the through-connection of a printed circuit board in a fully automatic manner.

The special design of the arms 2, 3 as is evident from FIG. 1 enables a resilience of the pin with regard to the free ends 21, 31 of the arms 2, 3. This compensates for different material expansions. The plastic body 4 can be fixed on the pin 1 in various ways. It is conceivable, for example, for the plastic body 4 to be injection-moulded onto the pin. Alternatively, it is possible for the pin 1 to be introduced into the inner opening of the plastic body 4 by means of a press fit. Two lugs 12, by means of which the pin is anchored in the plastic body 4, are evident particularly in FIG. 1.

FIG. 4 illustrates a contact with a different form of the arms 2, 3. This form has particularly good spring properties. The arms are arranged as follows: firstly near the pin angling of the arms at 45° away from the printed circuit board, then angling towards the printed circuit board parallel to the axis of the pin, finally the free end extends parallel to the printed circuit board. The pin 1 is provided with the plastic body 4 by injection-molding the plastic body 4 on part of the pin 1.

We claim:

1. A contact for the through-connection of a printed circuit board through a hole, comprising:

a central pin made of a conductive material, arms that are arranged on the pin on two opposite sides thereof for contacting the printed circuit board, a body is provided on one end of the pin, surrounding the pin and, on the side facing away from the pin, having a surface extending perpendicularly to the pin to form a suction pick-up surface for the contact, wherein the arms extend, at least in regions, perpendicularly to the pin, in such a way that when the free end of the pin is introduced into a hole, the perpendicularly extending regions of the arms touch the printed circuit board containing the hole with bearing faces and the bearing faces of the arms and the point where the arms loin the pin lie on a straight line perpendicular to the introduction direction.

2. A contact according to claim 1, wherein the body extends as far as that point on the pin at which the arms are provided on the pin.

3. A contact according to claim 1, wherein the body is injection-moulded onto the pin.

4. A contact according to claim 1, wherein the pin with the arms is stamped from a metal sheet.

5. A contact according to claim 1, wherein the body consists of a non-conductive material.

6. A contact according to claim 5, wherein a plastic part is provided as the body.

7. A contact according to claim 1, wherein the arms have the following bent profile: firstly, near to the pin, angling of the arms at 45° away from the printed circuit board, then angling towards the printed circuit board parallel to the axis of the pin, finally the free end runs parallel to the printed circuit board, towards the pin.

8. A contact according to claim 1, characterized in that the arms are fixed to the pin on one end and are freely moveable on the other end and in that the arms have the shape of a C.

9. A contact for the through-connection of a printed circuit board through a hole, comprising:

a central pin made of a conductive material, arms that are arranged on the pin on two opposite sides thereof for contacting the printed circuit board, a body is provided on one end of the pin, surrounding the pin and, on the side facing away from the pin, having a surface extending perpendicularly to the pin to form a suction pick-up surface for the contact, wherein the arms extend, at least in regions, perpendicularly to the pin, in such a way that when the free end of the pin is introduced into a hole, the perpendicularly extending regions of the arms touch the printed circuit board containing the hole with bearing faces and the arms have the following bent profile:

firstly, near to the pin, angling of the arms at 45° away from the printed circuit board, then angling towards the printed circuit board parallel to the axis of the pin, finally the free end runs parallel to the printed circuit board.

10. A contact according to claim 9, wherein the body extends as far as that point on the pin at which the arms are provided on the pin.

11. A contact according to claim 9, wherein the body is injection-molded onto the pin.

12. A contact according to claim 9, wherein the pin with the arms is stamped from a metal sheet.

13. A contact according to claim 9, wherein the body consists of a non-conductive material.

14. A contact according to claim 13, wherein a plastic part is provided as the body.

15. A contact according to claim 9, wherein the bearing faces of the arms and the point where the arms join the pin lie on a straight line perpendicular to the introduction direction.

16. A contact for connecting conductor tracks on two opposite sides of a printed circuit board by through-connection of the printed circuit board through a hole, comprising:

a central pin made of a conductive material having a free end for introducing into the hole and penetrating through the printed circuit board for connecting conductor tracks on the first side of the printed circuit board by soldering, arms that are arranged on the pin on two opposite sides thereof for contacting conductor tracks on the second side of the printed circuit board by soldering, the arms basically each having the shape of a C, which is fixed to the pin on one end and freely movable at the other end for compensating with this spring design different material expansions, and a body being provided on one end of the pin, surrounding the pin and, on the side facing away from the pin, having a surface extending perpendicularly to the pin to form a suction pick-up surface for the contact.

17. A contact according to claim 16, wherein the arms extend at least in regions, perpendicularly to the pin, in such a way that when the free end of the pin is introduced into a hole, the perpendicularly extending regions of the arms touch the printed circuit board containing the hole with bearing faces.

* * * * *